US011686467B1

(12) United States Patent
Yuan

(10) Patent No.: US 11,686,467 B1
(45) Date of Patent: Jun. 27, 2023

(54) LUMINOUS FAN CONNECTION STRUCTURE

(71) Applicant: PHANTEKS TAIWAN INC., New Taipei (TW)

(72) Inventor: Jin-Jong Yuan, New Taipei (TW)

(73) Assignee: PHANTEKS TAIWAN INC., New Taipei (TW)

( * ) Notice: Subject to any disclaimer, the term of this patent is extended or adjusted under 35 U.S.C. 154(b) by 0 days.

(21) Appl. No.: 17/981,304

(22) Filed: Nov. 4, 2022

(51) Int. Cl.
*F21V 33/00* (2006.01)
*F04D 29/52* (2006.01)
*F04D 19/00* (2006.01)

(52) U.S. Cl.
CPC ..... *F21V 33/0096* (2013.01); *F04D 19/002* (2013.01); *F04D 29/522* (2013.01)

(58) Field of Classification Search
CPC .... F21V 33/0096; F21V 29/67; F24F 13/078; F04D 19/002; F04D 29/522; F04D 29/002; F04D 29/023; F04D 29/601
See application file for complete search history.

(56) References Cited

U.S. PATENT DOCUMENTS 10,690,336 B1 * 6/2020 Chen ..... F21V 33/0096
2011/0116234 A1 * 5/2011 Ye ..... F21V 33/0096 362/96
2022/0049706 A1 * 2/2022 Fan ..... F04D 29/002

* cited by examiner

*Primary Examiner* — Y M. Quach Lee
(74) *Attorney, Agent, or Firm* — Chun-Ming Shih; HDLS IPR Services

(57) ABSTRACT

A luminous fan connection structure. The luminous fans are disposed adjacent to each other in a side-by-side manner. A blade is arranged in a frame base. A light guide ring combined with a light-emitting module is arranged annularly outside the blade. The frame base has a fan circuit board and a snap portion. The fan circuit board is electrically connected to the blade and the light-emitting module. The external connector includes a board seat and a connection circuit board. The board seat includes a pair of hooks. The connection circuit board includes a first and a second conductive pin. The board seat straddles between luminous fans. The pair of hooks are respectively fastened with the snap portions of the adjacent luminous fans, and the first conductive pin is electrically connected to one fan circuit board, and the second conductive pin is electrically connected to another fan circuit board.

10 Claims, 9 Drawing Sheets

LUMINOUS FAN CONNECTION STRUCTURE

BACKGROUND OF THE DISCLOSURE

Technical Field

This disclosure relates to a heat dissipation fan, and more particularly relates to a luminous fan connection structure.

Description of Related Art

Generally, electronic components disposed inside electronic products may generate heat during the operation. If the heat is not dissipated in time, the electronic products may fail or even damage due to overheating.

Moreover, the use of fans to generate forced airflow to dissipate heat from heat sources is a common and effective way to dissipate heat. Additionally, with the increasing requirements for heat dissipation, users may discharge the accumulated heat energy by increasing the number of fans. However, fans are mostly electrically connected through wires or transmission lines. Therefore, when the number of the fans increases, the cumbersome and complicated wires may cause troubles in the cable routing. Furthermore, if the fans are further provided with light-emitting modules, the light emitted by the light-emitting modules may have a decorative effect to to increase the overall aesthetics of the fans.

In view of the above drawbacks, the inventor proposes this disclosure based on his expert knowledge and elaborate researches in order to solve the problems of related art.

SUMMARY OF THE DISCLOSURE

One object of this disclosure is to provide a luminous fan connection structure to reduce the complexity of cable routing and increase the convenience of use.

Another object of this disclosure is to provide a luminous fan connection structure to have a decorative effect by the light emitted from the light-emitting module to increase the overall aesthetics of the fan.

In order to achieve the above objects, this disclosure is a luminous fan connection structure including a plurality of luminous fans and at least one external connector. The luminous fans are disposed adjacent to each other in a side-by-side manner. Each luminous fan includes a frame base, a blade, a light-emitting module and a light guide ring. The blade is arranged in the frame base, and the light guide ring is combined with the light-emitting module and arranged annularly outside the blade. A fan circuit board and a snap portion are disposed on the frame base. The fan circuit board is electrically connected to the blade and the light-emitting module. The external connector includes a board seat and a connection circuit board disposed on the board seat. A pair of hooks are disposed oppositely on two sides of the board seat. A first conductive pin and a second conductive pin are arranged on two sides of the connection circuit board opposite to each other. The board seat straddles the between luminous fans. The pair of hooks are respectively fastened with the snap portions of the adjacent luminous fans, and the first conductive pin is electrically connected to one of fan circuit boards of the adjacent luminous fans, and the second conductive pin is electrically connected to another fan circuit board of the adjacent luminous fans.

In comparison with the related art, the luminous fans of this disclosure are disposed adjacent to each other in a side-by-side manner, and the external connector straddles the adjacent luminous fans. Moreover, the hooks of the external connector are fastened with the snap portions of the adjacent luminous fans. As a result, the first conductive pin located on one side of the external connector is electrically connected to one of the fan circuit boards of the adjacent luminous fans. Additionally, the second conductive pin located on another side of the external connector is electrically connected to another fan circuit board of the adjacent luminous fans. Therefore, the adjacent luminous fans are connected in a side-by-side manner, and the electrical connection is completed at the same time. Therefore, the complex operation of cable routing for fans of the related art for electrical connection and transmission are eliminated to increase the convenience of use. Furthermore, the fan of this disclosure is provided with a light-emitting module to decorate the overall appearance and increase the aesthetics of the product.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
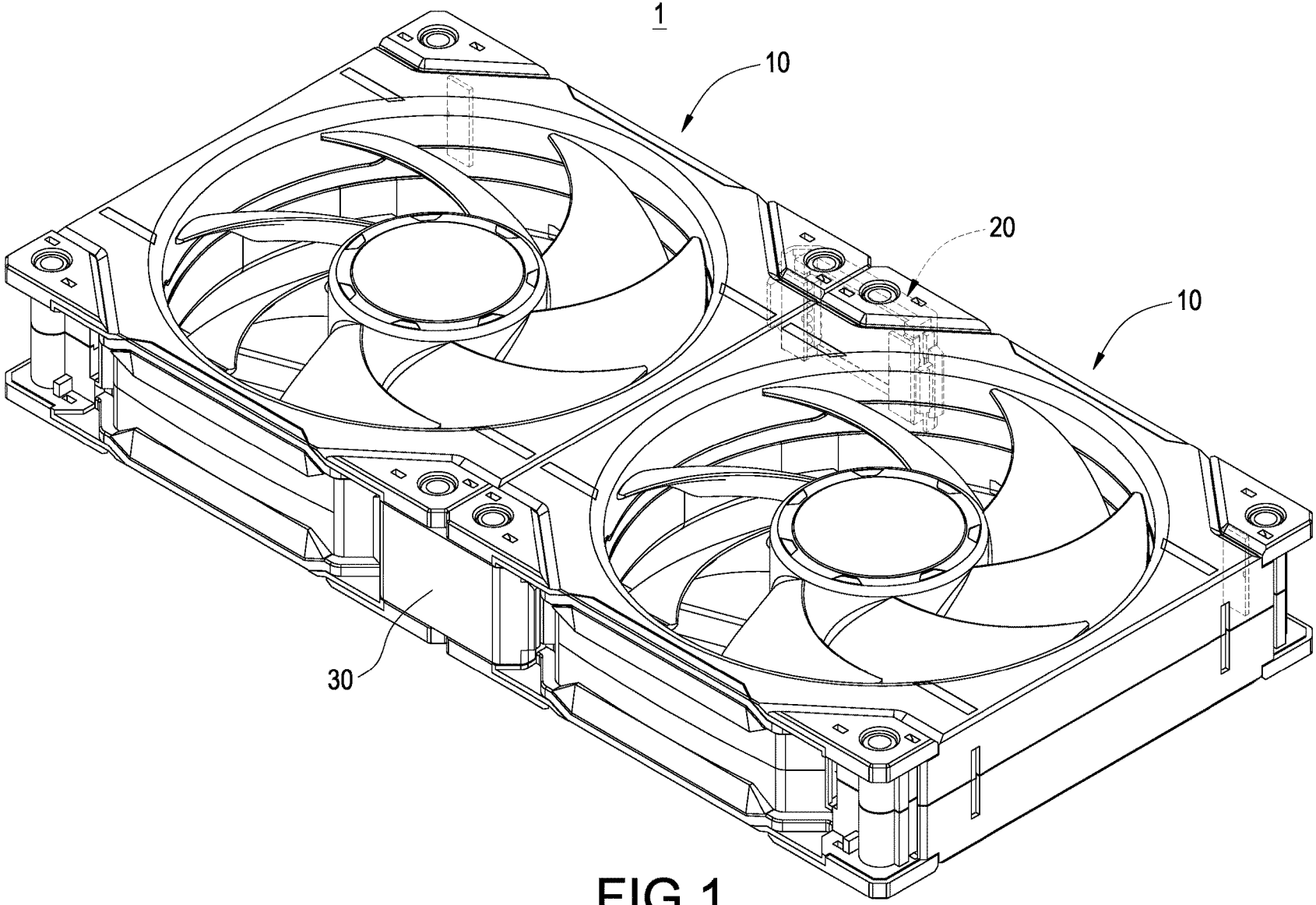
FIG. 1 is a perspective schematic view of the luminous fan connection structure in this disclosure.
Figure 2:
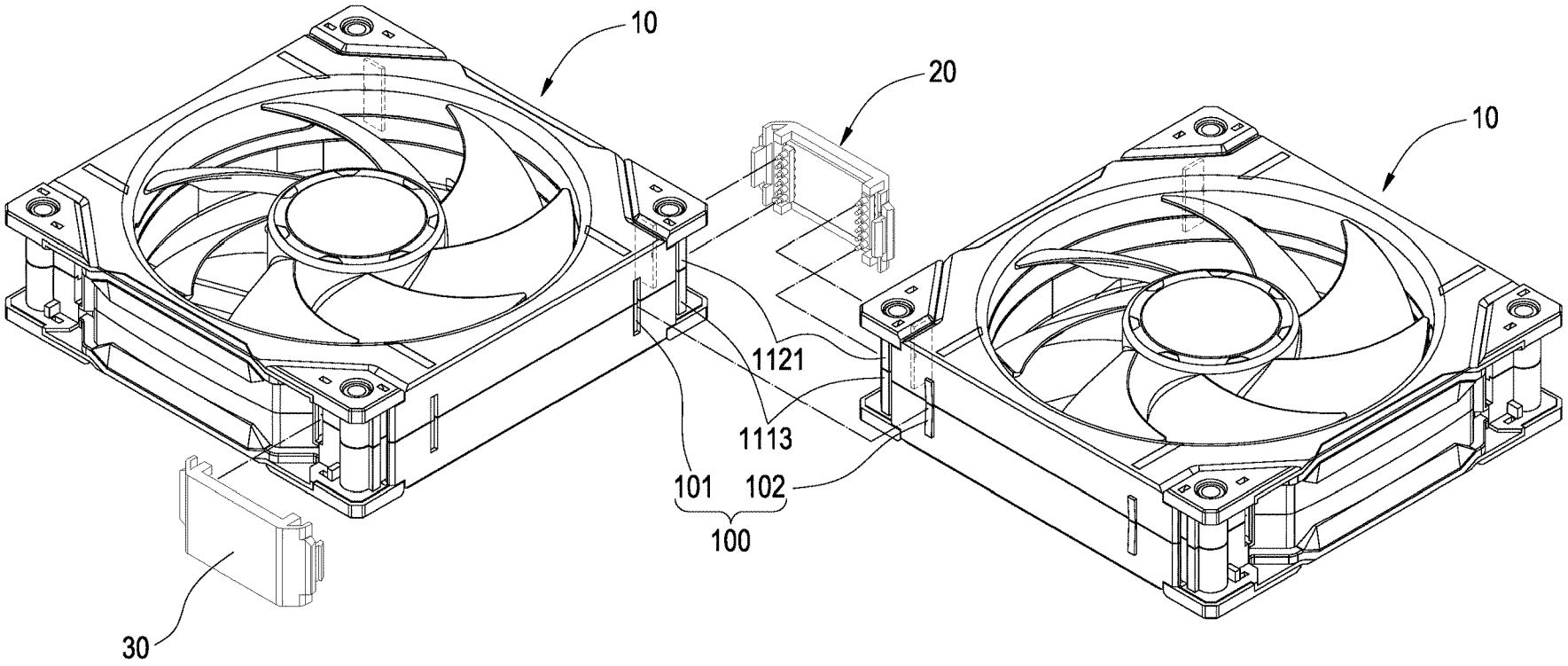
FIG. 2 is a perspective exploded schematic view of the luminous fan connection structure in this disclosure.
Figure 3:
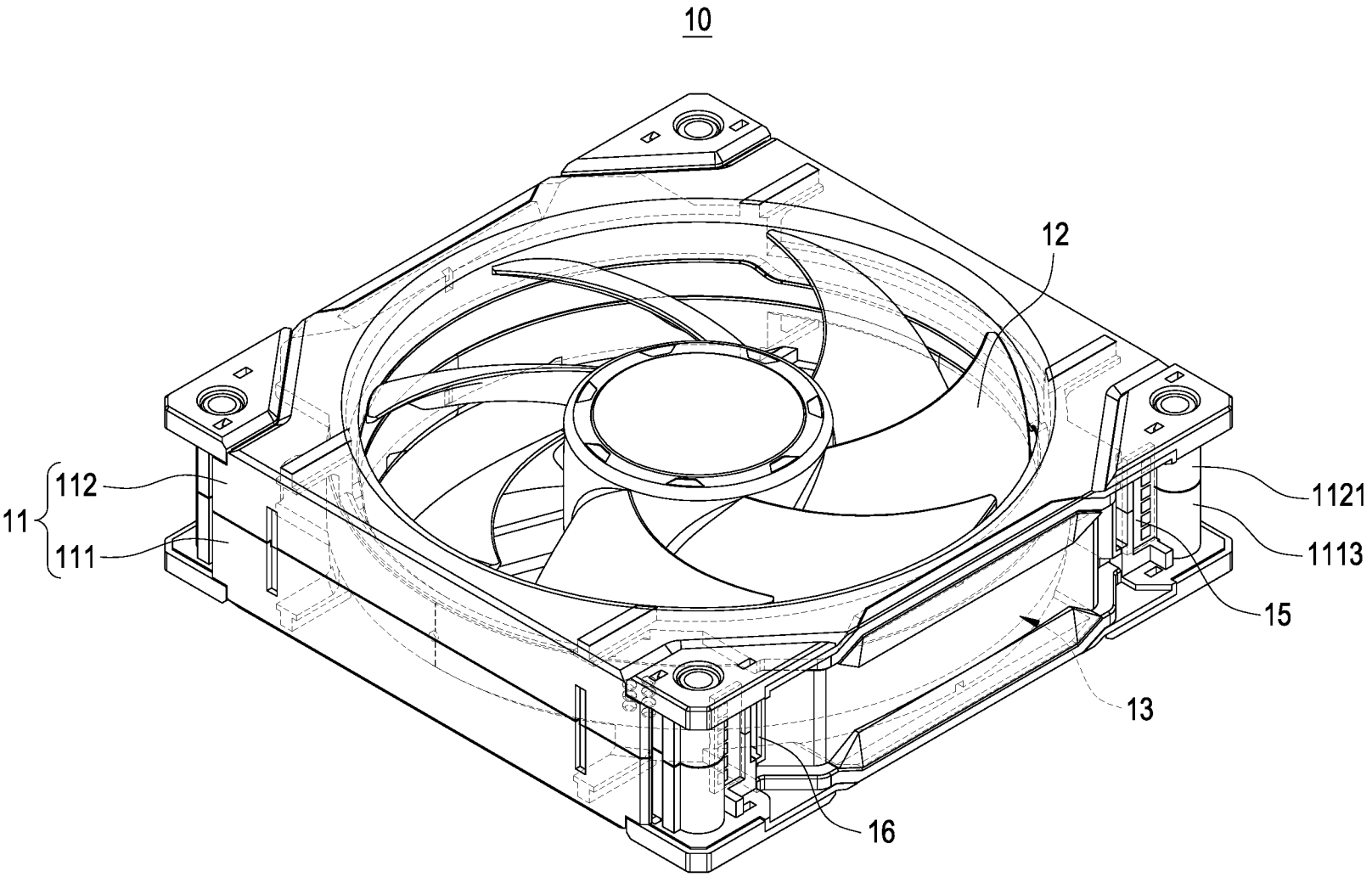
FIG. 3 is a perspective schematic view of the luminous fan in this disclosure.
Figure 4:
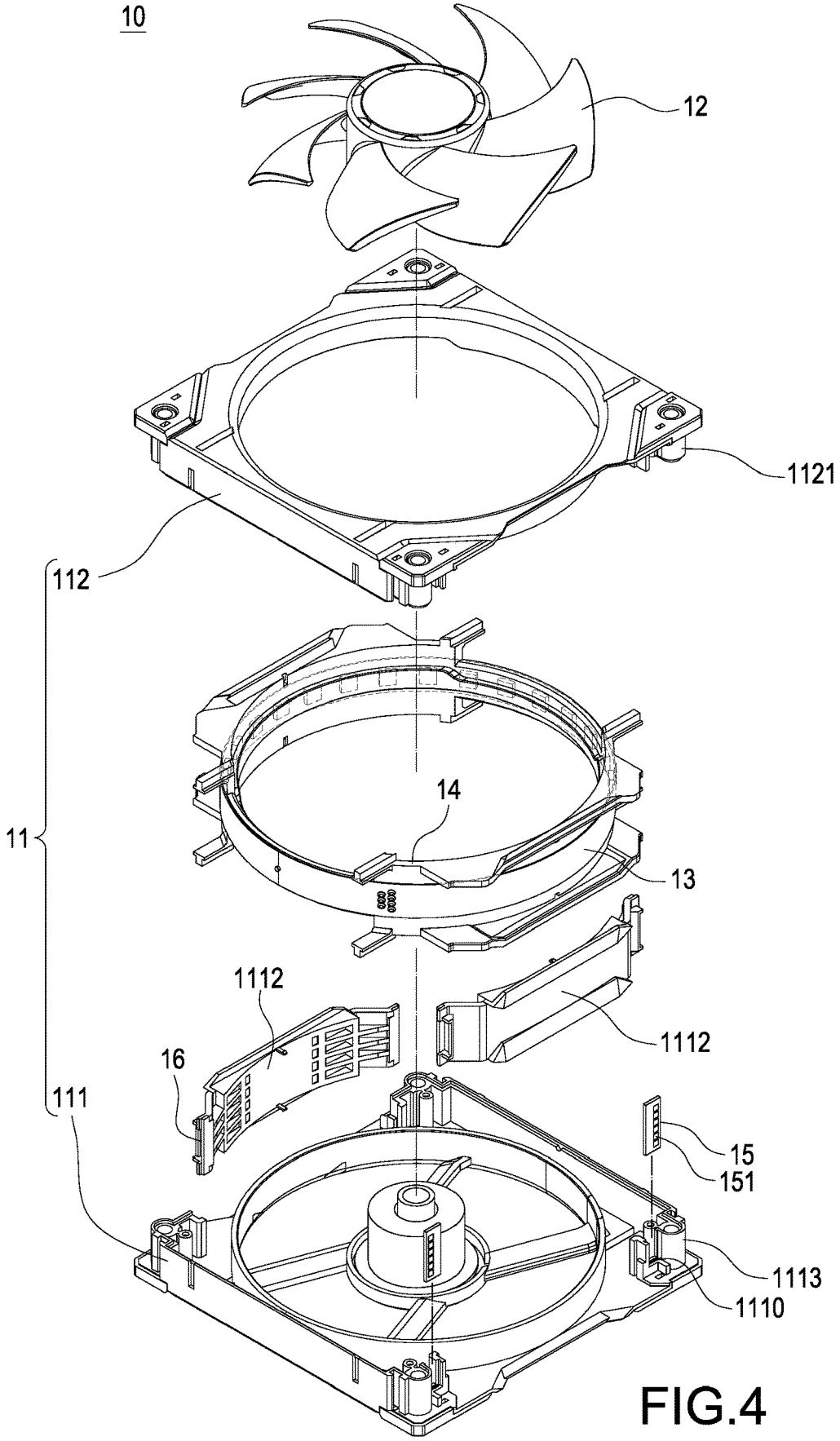
FIG. 4 is a perspective exploded schematic view of the luminous fan in this disclosure.
Figure 5:
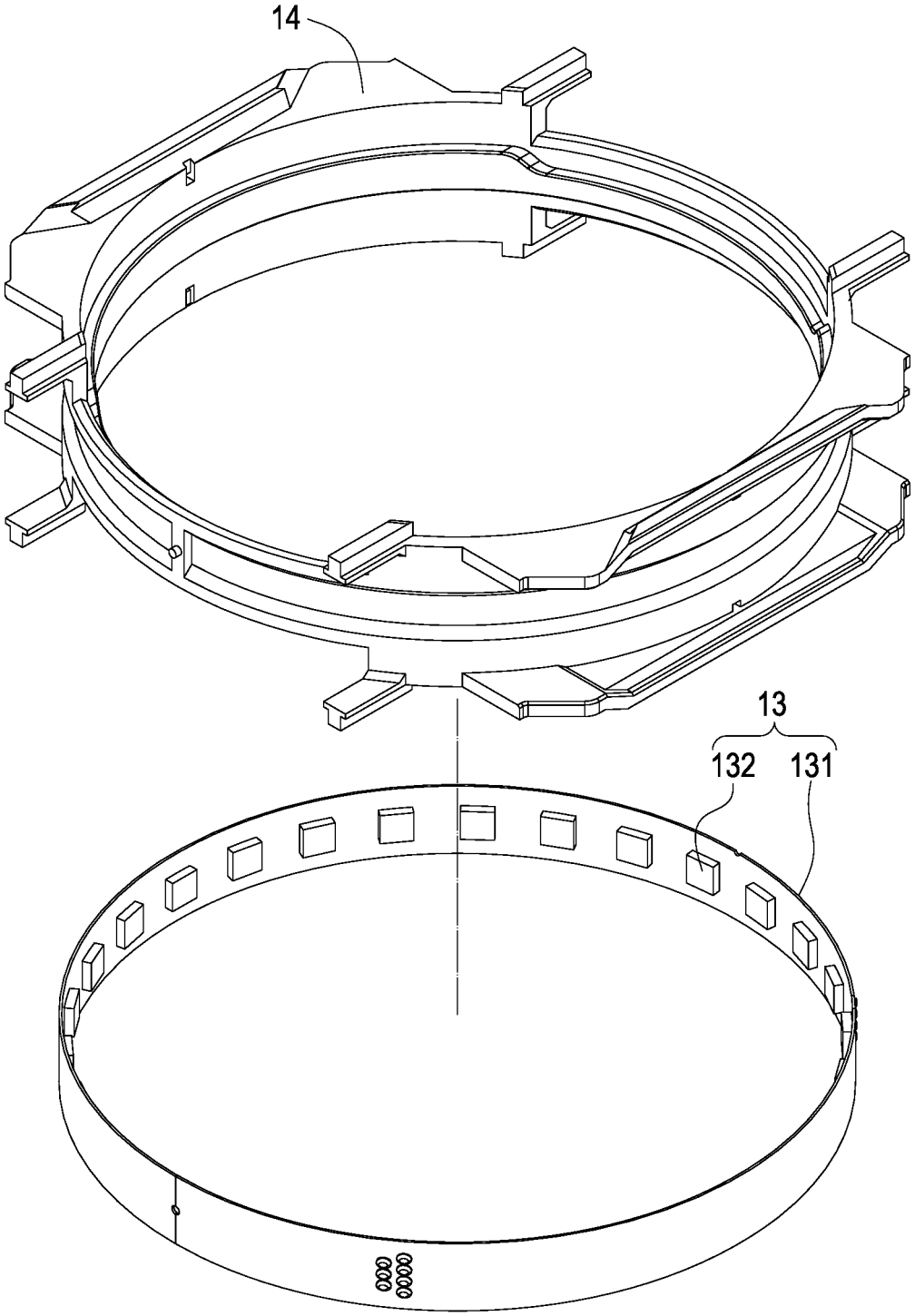
FIG. 5 is a perspective exploded schematic view of the light-emitting module and the light guide ring in this disclosure.
Figure 6:
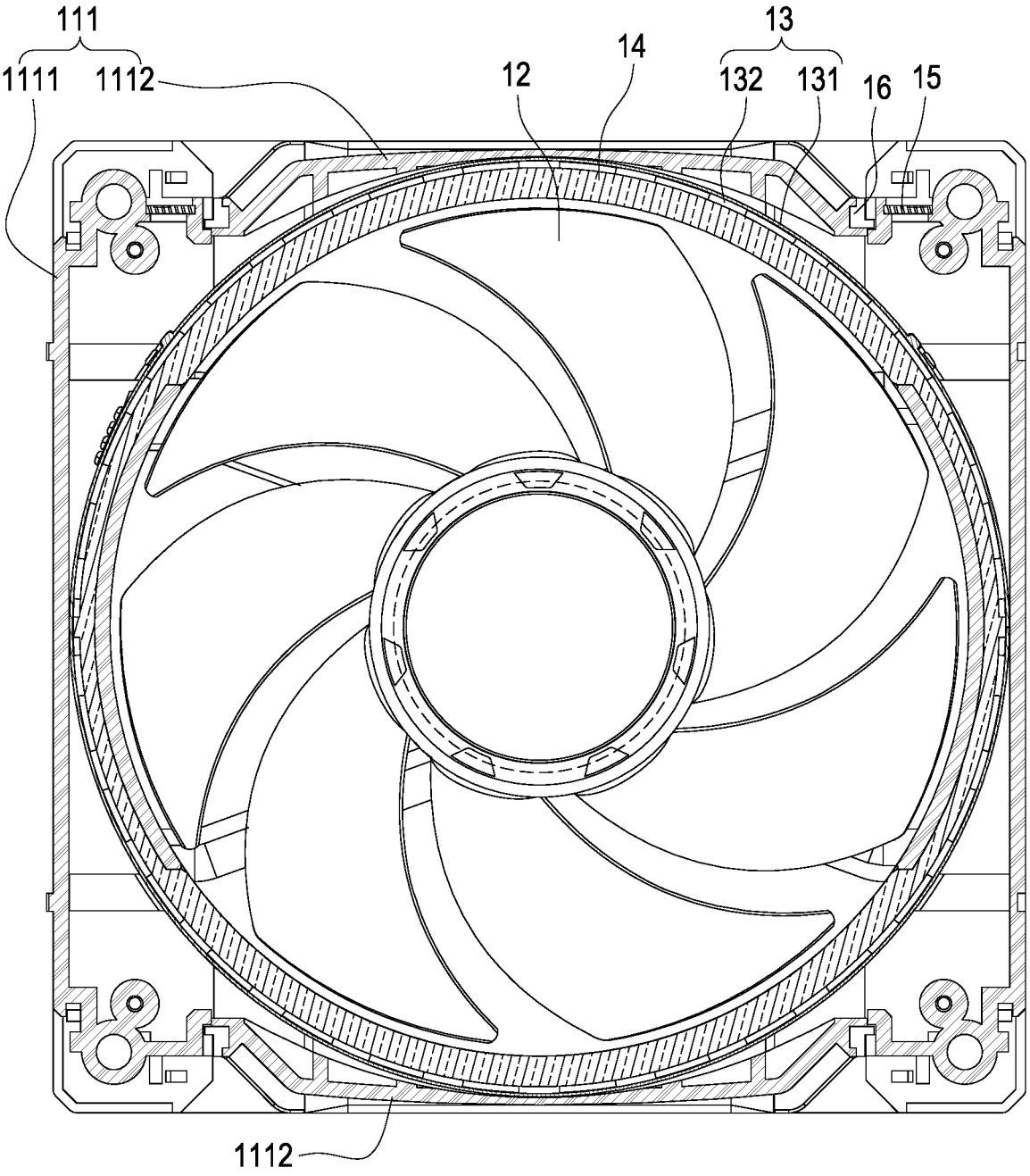
FIG. 6 is a cross-sectional view of the luminous fan in this disclosure.

Please refer to FIG. 1 and FIG. 2, which are a perspective schematic view and a perspective exploded view of the luminous fan connection structure in this disclosure. This disclosure is a luminous fan connection structure 1 including a plurality of luminous fans 10 and at least one external connector 20. The luminous fans 10 are disposed adjacent to each other in a side-by-side manner, and the luminous fans 10 are electrically connected through the external connector 20. Moreover, the external connector 20 straddles the adjacent luminous fans 10. Therefore, the number of the external connectors 20 is the number of the luminous fan 10 minus one. For example, in this embodiment, the number of the luminous fan 10 is two, and the number of the external connectors 20 is one.

It should be noted that in the embodiment, the luminous fan connection structure 1 further includes a hook seat 30. The hook seat 30 is disposed opposite to the external connector 20 and straddles the adjacent luminous fans 10 for structurally connecting the adjacent luminous fans 10. The hook seat 30 is free from the electrical connection function, but is similar to the external connector 20 in structure. The luminous fan connection structure 1 is described in more detail as follows.

It is worth of noticing that in this embodiment, each of the luminous fans 10 includes a plurality of positioning portions 100. Each of the positioning portions 100 includes a positioning groove 101 and a positioning rib 102 disposed correspondingly. Furthermore, the adjacent luminous fans 10 abut against with each other in a side-by-side manner and are positioned through the engagement of the positioning grooves 101 and the positioning ribs 102.

Please further refer to FIG. 3 to FIG. 6, which are a perspective schematic view of the luminous fan in this disclosure, a perspective exploded view of the luminous fan in this disclosure, a perspective exploded schematic view of the light-emitting module and the light guide ring in this disclosure, and a cross-sectional view of the luminous fan in this disclosure. As shown in the figures, each luminous fan 10 includes a frame base 11, a blade 12, a light-emitting module 13 and a light guide ring 14. The blade 12 is arranged in the frame base 11. The light guide ring 14 is combined with the light-emitting module 13 and arranged annularly outside the blade 12. Additionally, a fan circuit board 15 and a snap portion 16 are disposed on two sides of the frame base 11 opposite to each other. The fan circuit board 15 is electrically connected to the blade 12 and the light-emitting module 13. In one embodiment of this disclosure, each fan circuit board 15 includes a plurality of conductive pads 151.

Specifically, the frame base 11 includes a lower frame 111 and an upper frame 112 combined with the lower frame 111. Moreover, the light guide ring 14 combined with the light-emitting module 13 is clamped between the lower frame 111 and the upper frame 112. The lower frame 111 includes a base 1111 and a pair of side plates 1112 combined on two sides of the base 1111. Additionally, in this embodiment, the snap portion 16 includes a slot disposed on each side plate 1112 adjacent to one side of the base 1111.

In this embodiment, the light-emitting module 13 includes a flexible circuit board 131 and a plurality of LEDs 132 disposed on the flexible circuit board 131. The light emitted from the LEDs 132 may be diffused through the light guide ring 14 to form the lighting effect for decorating the overall appearance.

Further, the lower frame 111 includes a plurality of lower supporting columns 1113, and the upper frame 112 includes a plurality of upper supporting columns 1121. The lower supporting columns 1113 respectively abut against the upper supporting columns 1121. Additionally, the lower frame 111 includes a guide groove 1110 disposed on a side of each lower supporting column 1113. The fan circuit board 15 is combined in the guide groove 1110.

Figure 7:
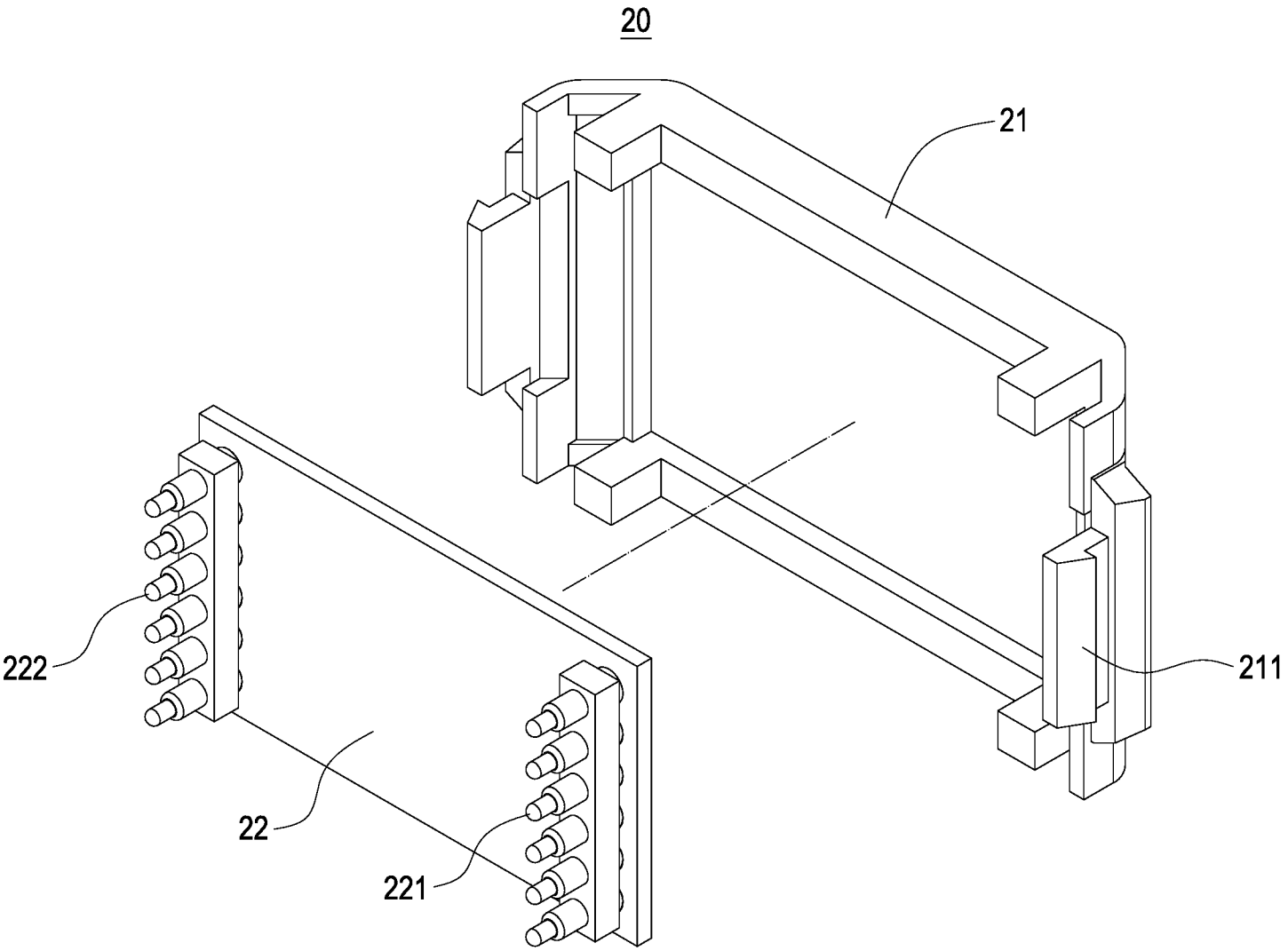
FIG. 7 is a perspective exploded schematic view of the external connector in this disclosure.
Figure 8:
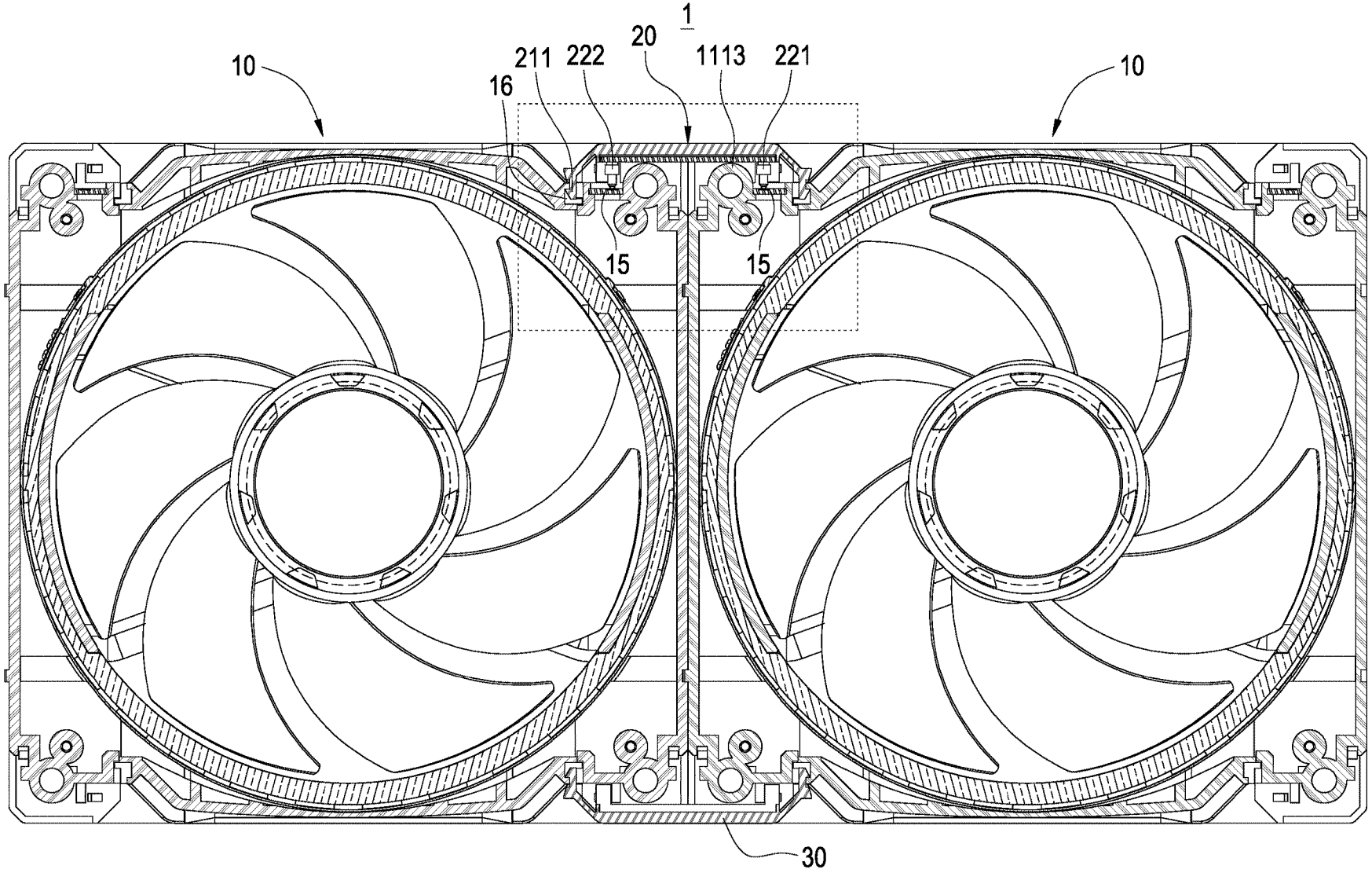
FIG. 8 is a cross-sectional view of the luminous fan connection structure in this disclosure.
Figure 9:
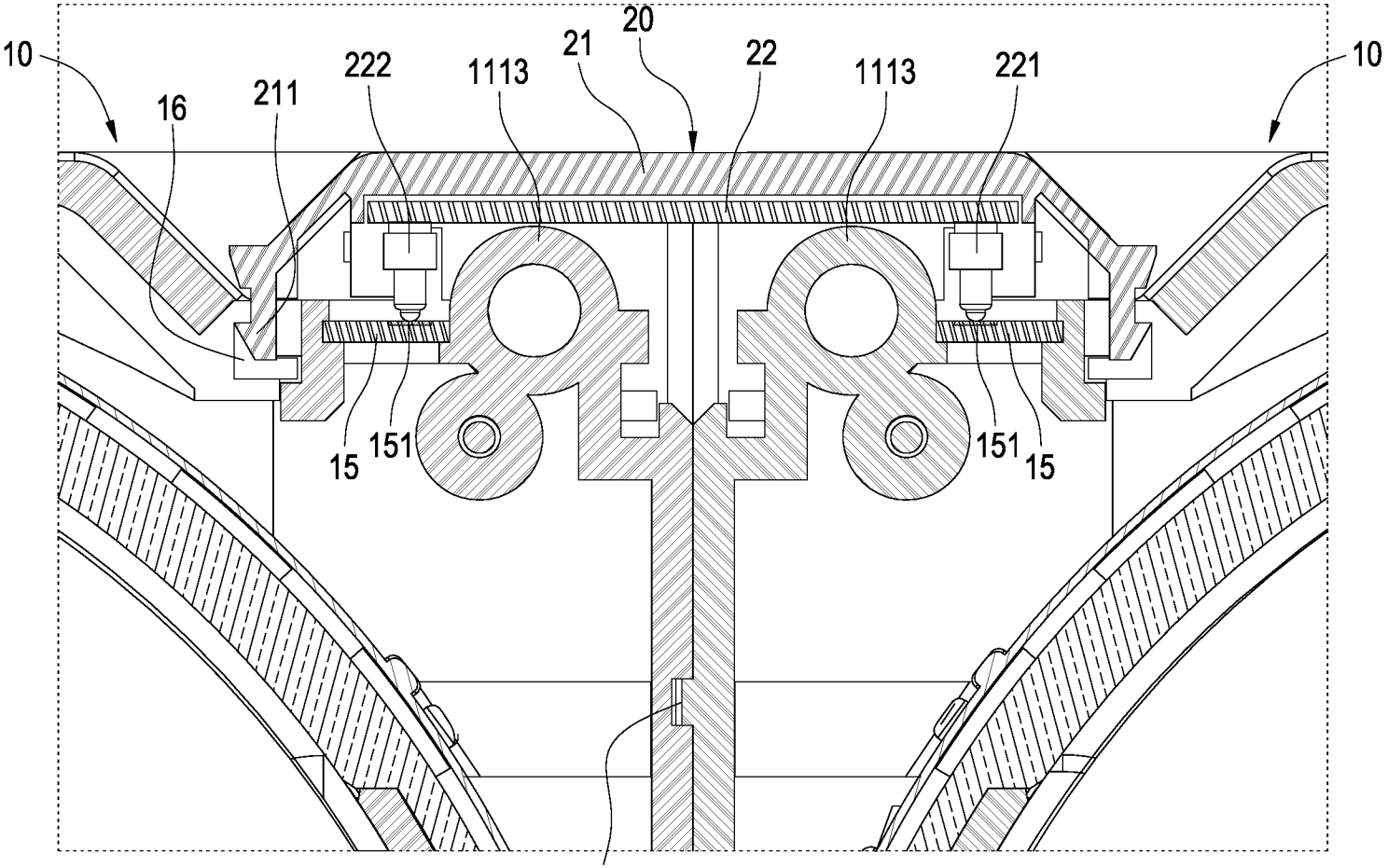
FIG. 9 is a partially enlarged schematic view of the luminous fan connection structure in this disclosure.

Please further refer to FIG. 7 to FIG. 9, which are a perspective exploded schematic view of the external connector in this disclosure, a cross-sectional view of the luminous fan connection structure in this disclosure, and a partial enlarged schematic view of the luminous fan connection structure in this disclosure. As shown in FIG. 7, the external connector 20 includes a board seat 21 and a connection circuit board 22 disposed on the board seat 21. A pair of hooks 211 are disposed on two sides of the board seat 21 opposite to each other. Furthermore, a first conductive pin 221 and a second conductive pin 222 are arranged oppositely on two sides of the connection circuit board 22. In this embodiment, the number of the first conductive pin 221 and the number of the second conductive pin 222 are multiple. The first conductive pins 221 and the second conductive pins 222 are disposed spacedly and arranged in a linear manner on two sides of the board seat 21.

As shown in FIG. 8 and FIG. 9, the luminous fan connection structure 1 in this disclosure includes a plurality of luminous fans 10 disposed adjacent to each other in a side-by-side manner. The adjacent luminous fans 10 include the lower supporting columns 1113 and the upper supporting columns 1121 arranged in a side-by-side manner. Moreover, the board seat 21 of the external connector 20 straddles the adjacent luminous fans 10. The board seat 21 encloses and covers the outer side of the lower supporting columns 1113 and the upper supporting columns 1121 arranged in a side-by-side manner (further refer to FIG. 2).

Moreover, the pair of hooks 211 of the external connector 20 are respectively fastened with the snap portions 16 of the adjacent luminous fans 10, so that the first conductive pin 221 is electrically connected to the conductive pads 151 of one of the fan circuit boards 15 of the adjacent luminous fans 10. Additionally, the second conductive pin 222 is electrically connected to the conductive pads 151 of another fan circuit board 15 of the adjacent luminous fans 10. Therefore, the adjacent luminous fans 10 are connected in a side-by-side manner and are electrically connected at the same time.

While this disclosure has been described by means of specific embodiments, numerous modifications and variations could be made thereto by those skilled in the art without departing from the scope and spirit of this disclosure set forth in the claims.

What is claimed is:

1. A luminous fan connection structure (1), comprising:

a plurality of luminous fans (10), disposed adjacent to each other in a side-by-side manner, each luminous fan comprising a frame base (11), a blade (12), a light-emitting module (13) and a light guide ring (14), wherein the blade (12) is arranged in the frame base (11), and the light guide ring (14) is combined with the light-emitting module (13) and arranged annularly outside the blade (12); a fan circuit board (15) and a snap portion (16) are disposed on the frame base (11); and the fan circuit board (15) is electrically connected to the blade (12) and the light-emitting module (13); and at least one external connector (20), comprising a board seat (21) and a connection circuit board (22) disposed on the board seat (21), wherein the board seat (21) comprises a pair of hooks (211) disposed oppositely on two sides thereof; the connection circuit board (22) comprises a first conductive pin (221) and a second conductive pin (222) disposed oppositely to each other; the board seat (21) straddles between the luminous fans (10) adjacent to each other; and the pair of hooks (211) are fastened with a pair of snap portions (16) of the luminous fans (10) adjacent to each other, and the first conductive pin (221) is electrically connected to one of the fan circuit boards (15) of the luminous fans (10) adjacent to each other, and the second conductive pin (222) is electrically connected to another one of the fan circuit boards (15) of the luminous fans (10) adjacent to each other.

2. The luminous fan connection structure (1) according to claim 1, wherein the frame base (11) comprises a lower frame (111) and an upper frame (112) combined with the lower frame (111); and the light guide ring (14) combined with the light-emitting module (13) is clamped between the lower frame (111) and the upper frame (112).

3. The luminous fan connection structure (1) according to claim 2, wherein the lower frame (111) comprises a base (1111) and a pair of side plates (1112) connected on two sides of the base (1111) opposite to each other; and the snap portion (16) comprises a slot disposed on each side plate (1112) adjacent to one side of the base (1111).

4. The luminous fan connection structure (1) according to claim 3, wherein one of the pair of hooks (211) of the board seat (21) is engaged in the slot correspondingly.

5. The luminous fan connection structure (1) according to claim 2, wherein the lower frame (111) comprises a plurality of lower supporting columns (1113); the upper frame (112) comprises a plurality of upper supporting columns (1121); and the plurality of upper supporting columns (1121) respectively abut against the plurality of lower supporting columns (1113).

6. The luminous fan connection structure (1) according to claim 5, wherein the plurality of lower supporting columns (1113) and the plurality of upper supporting columns (1121) are arranged in a side-by-side manner between the luminous fans adjacent to each other; and the board seat (21) encloses and covers an outer side of the plurality of lower supporting columns (1113) and the plurality of upper supporting columns (1121) arranged in a side-by-side manner.

7. The luminous fan connection structure (1) according to claim 5, wherein the lower frame (111) comprises a guide groove (1110) disposed on a side of each lower supporting column (1113), and the fan circuit board (15) is received in the guide groove (1110).

8. The luminous fan connection structure (1) according to claim 1, wherein each of the plurality of luminous fans (10) comprises a plurality of positioning portions (100).

9. The luminous fan connection structure (1) according to claim 8, wherein each of the plurality of positioning portions (100) comprises a positioning groove (101) and a positioning rib (102) disposed corresponding to each other.

10. The luminous fan connection structure (1) according to claim 1, wherein the fan circuit board (15) comprises a plurality of conductive pads (151); a number of the first conductive pin and a number of the second conductive pin (221, 222) are multiple respectively; and a plurality of first conductive pins and a plurality of second conductive pins (221, 222) are respectively connected to the conductive pads (151).

* * * * *